US010504643B2

(12) United States Patent
Shepard et al.

(10) Patent No.: US 10,504,643 B2
(45) Date of Patent: Dec. 10, 2019

(54) ELECTRICAL DEVICE WITH FLEXIBLE CONNECTORS

(71) Applicant: Hamilton Sundstrand Corporation, Charlotte, NC (US)

(72) Inventors: Charles Patrick Shepard, DeKalb, IL (US); Shin Katsumata, Rockford, IL (US)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 43 days.

(21) Appl. No.: 15/379,631

(22) Filed: Dec. 15, 2016

(65) Prior Publication Data

US 2018/0174728 A1 Jun. 21, 2018

(51) Int. Cl.

| | |
|---|---|
| ***H01F 17/06*** | (2006.01) |
| ***H01F 27/28*** | (2006.01) |
| ***H01F 27/29*** | (2006.01) |

(52) U.S. Cl.

CPC ..... *H01F 17/062* (2013.01); *H01F 27/2804* (2013.01); *H01F 27/2895* (2013.01); *H01F 27/29* (2013.01); *H01F 27/2866* (2013.01); *H01F 27/292* (2013.01); *H01F 2027/2814* (2013.01)

(58) Field of Classification Search

CPC ..... H01F 27/29; H01F 27/2804

USPC ..... 336/200, 229, 232

See application file for complete search history.

(56) References Cited

U.S. PATENT DOCUMENTS

| | | | | |
|---|---|---|---|---|
| 5,392,020 | A * | 2/1995 | Chang | H01F 17/0033 336/182 |
| 5,828,283 | A * | 10/1998 | Choi | H01F 27/2804 336/200 |
| 7,109,838 | B2 * | 9/2006 | Brennan | H01F 17/0033 257/E21.022 |
| 7,973,635 | B2 | 7/2011 | Baarman et al. | |
| 8,538,553 | B2 | 9/2013 | Zhao et al. | |
| 9,123,461 | B2 | 9/2015 | Carsten | |
| 9,338,895 | B2 | 5/2016 | Clayton et al. | |

(Continued)

FOREIGN PATENT DOCUMENTS

| | | | | |
|---|---|---|---|---|
| DE | 4100963 | A1 | 7/1992 | |
| GB | 1218681 | A * | 1/1971 | H01F 17/0033 |

(Continued)

OTHER PUBLICATIONS

Search Report dated May 14, 2018 in U380837EP, EP Application No. 17207726, 9 pages.

*Primary Examiner* — Tszfung J Chan

(74) *Attorney, Agent, or Firm* — Cantor Colburn LLP

(57) ABSTRACT

An electrical device includes a first flexible connector, including a first flexible conductor and a second flexible conductor, and a flexible insulator disposed between the first flexible conductor and the second flexible conductor, a second flexible connector spaced apart from the first flexible connector, the second flexible connector including a third flexible conductor, a first interconnect to electrically connect the first flexible conductor and the third flexible conductor, a second interconnect to electrically connect the third flexible conductor and the second flexible conductor, wherein the second interconnect is disposed opposite the first interconnect.

15 Claims, 7 Drawing Sheets

(56) References Cited

U.S. PATENT DOCUMENTS

| | | | | |
|---|---|---|---|---|
| 2003/0025585 | A1* | 2/2003 | Macerini | H01F 27/2804 336/65 |
| 2006/0109071 | A1* | 5/2006 | Thongsouk | H01F 17/0033 336/200 |
| 2012/0194314 | A1* | 8/2012 | Mo | H05K 1/165 336/200 |
| 2015/0061817 | A1* | 3/2015 | Lee | H01F 17/0013 336/221 |
| 2015/0302975 | A1* | 10/2015 | Qi | H01F 41/041 336/200 |

FOREIGN PATENT DOCUMENTS

| | | | | |
|---|---|---|---|---|
| GB | 2308924 | A | 2/2000 | |
| JP | 61237407 | A * | 10/1986 | H01F 17/0033 |
| JP | S61237407 | A | 10/1986 | |
| WO | 1997024739 | A1 | 7/1997 | |

* cited by examiner

ELECTRICAL DEVICE WITH FLEXIBLE CONNECTORS

BACKGROUND

The subject matter disclosed herein relates to electrical devices, and more particularly, to electrical devices that utilize flexible connectors.

Electrical devices such as transformers and inductors are utilized in many applications to convert power and filter input and output signals. Transformers and inductors require numerous electrical conductors in a desired arrangement to provide the desired functionality. Often, creating and arranging the numerous electrical conductors is expensive and difficult.

BRIEF SUMMARY

According to an embodiment, an electrical device includes a first flexible connector, including a first flexible conductor and a second flexible conductor, and a flexible insulator disposed between the first flexible conductor and the second flexible conductor, a second flexible connector spaced apart from the first flexible connector, the second flexible connector including a third flexible conductor, a first interconnect to electrically connect the first flexible conductor and the third flexible conductor, a second interconnect to electrically connect the third flexible conductor and the second flexible conductor, wherein the second interconnect is opposite the first interconnect.

According to an embodiment an electrical device includes a first printed wiring board including a first interconnect, a second printed wiring board including a second interconnect, a first flexible connector disposed between the first printed wiring board and the second printed wiring board, the first flexible connector including a first flexible conductor and a second flexible conductor, and a flexible insulator disposed between the first flexible conductor and the second flexible conductor, a second flexible connector spaced apart from the first flexible connector and disposed between the first printed wiring board and the second printed wiring board, the second flexible connector including a third flexible conductor, wherein the first interconnect electrically connects the first flexible conductor and the third flexible conductor, and the second interconnect electrically connects the third flexible conductor and the second flexible conductor, wherein the second interconnect is opposite the first interconnect.

Technical function of the embodiments described above includes a first interconnect to electrically connect the first flexible conductor and the third flexible conductor, a second interconnect to electrically connect the third flexible conductor and the second flexible conductor, wherein the second interconnect is opposite the first interconnect.

Other aspects, features, and techniques of the embodiments will become more apparent from the following description taken in conjunction with the drawings.

BRIEF DESCRIPTION OF THE DRAWINGS

The subject matter is particularly pointed out and distinctly claimed in the claims at the conclusion of the specification. The foregoing and other features, and advantages of the embodiments are apparent from the following detailed description taken in conjunction with the accompanying drawings in which like elements are numbered alike in the FIGURES:

DETAILED DESCRIPTION

Figure 1A:
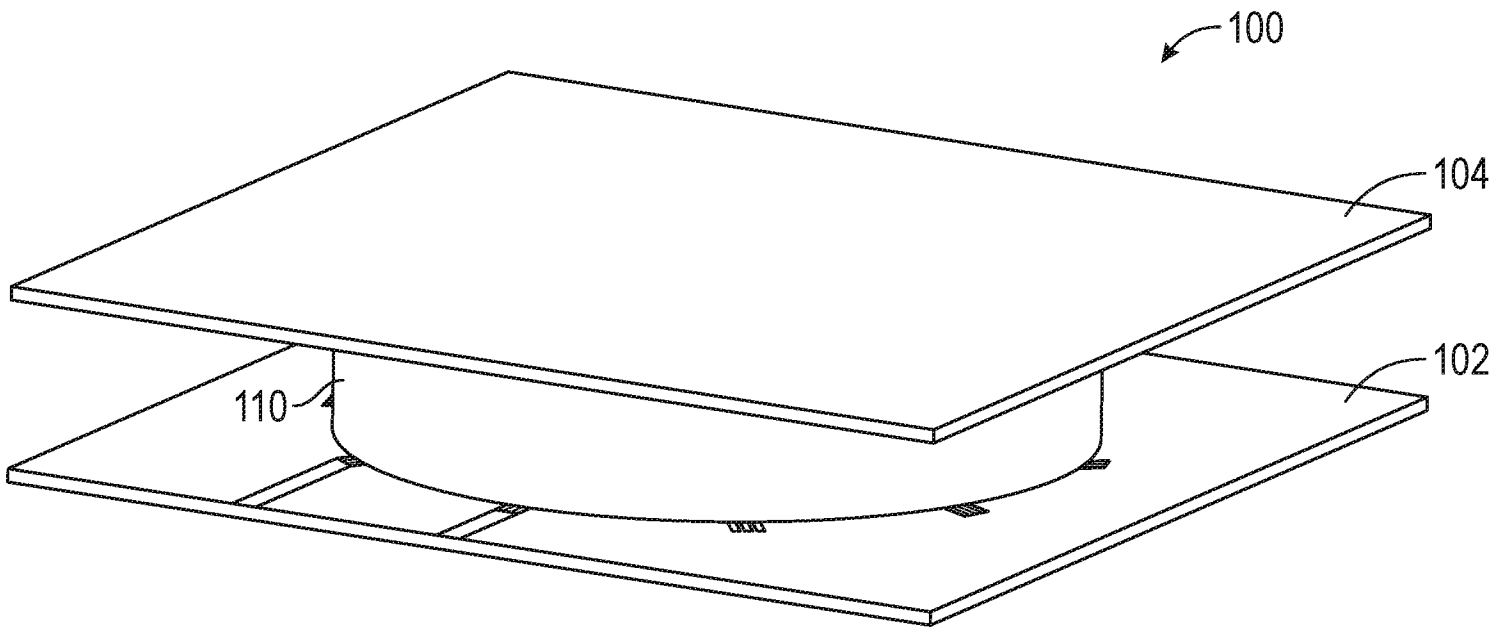
FIG. 1A is an isometric view of an embodiment of an electrical device assembly.
Figure 1B:
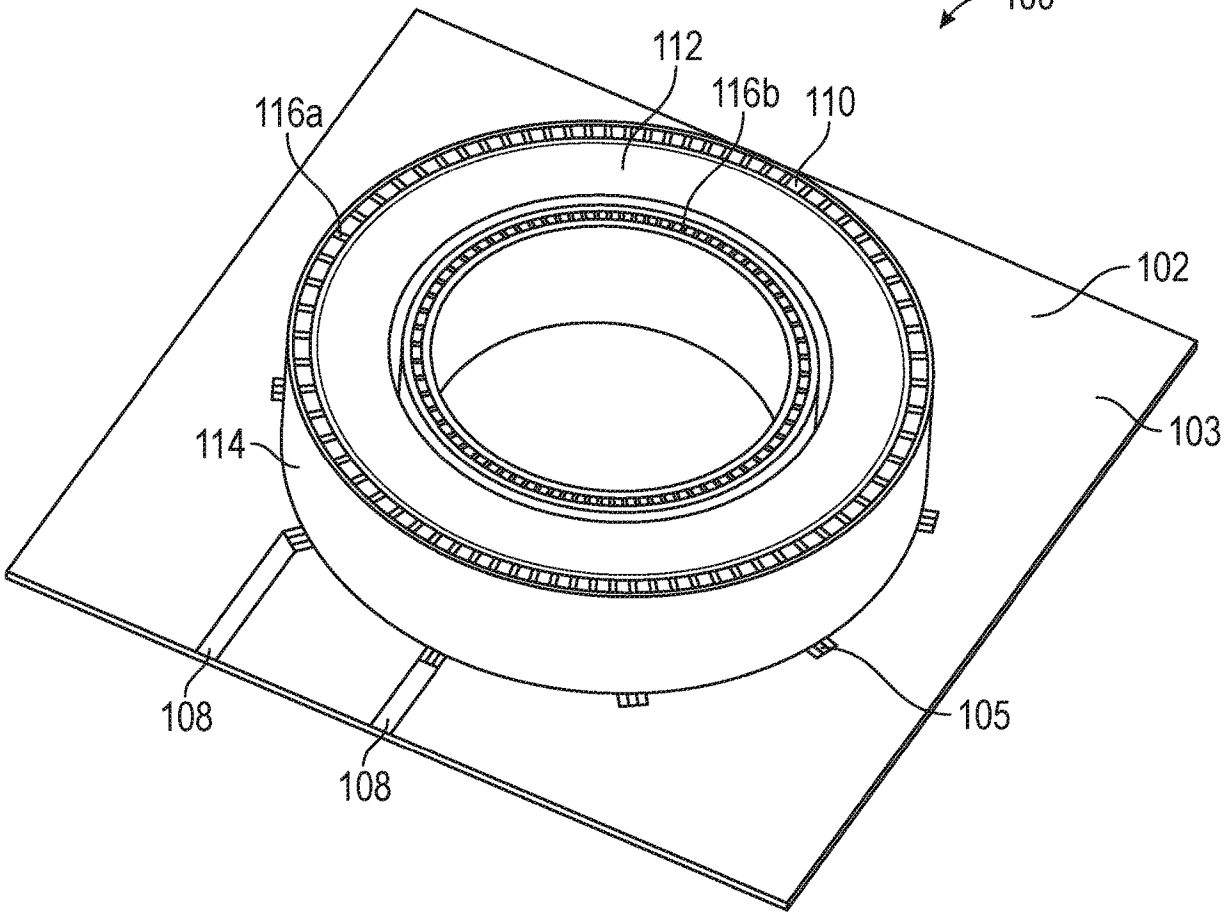
FIG. 1B is an isometric view of the electrical device assembly of FIG. 1A with the upper printed wiring board removed.
Figure 1C:
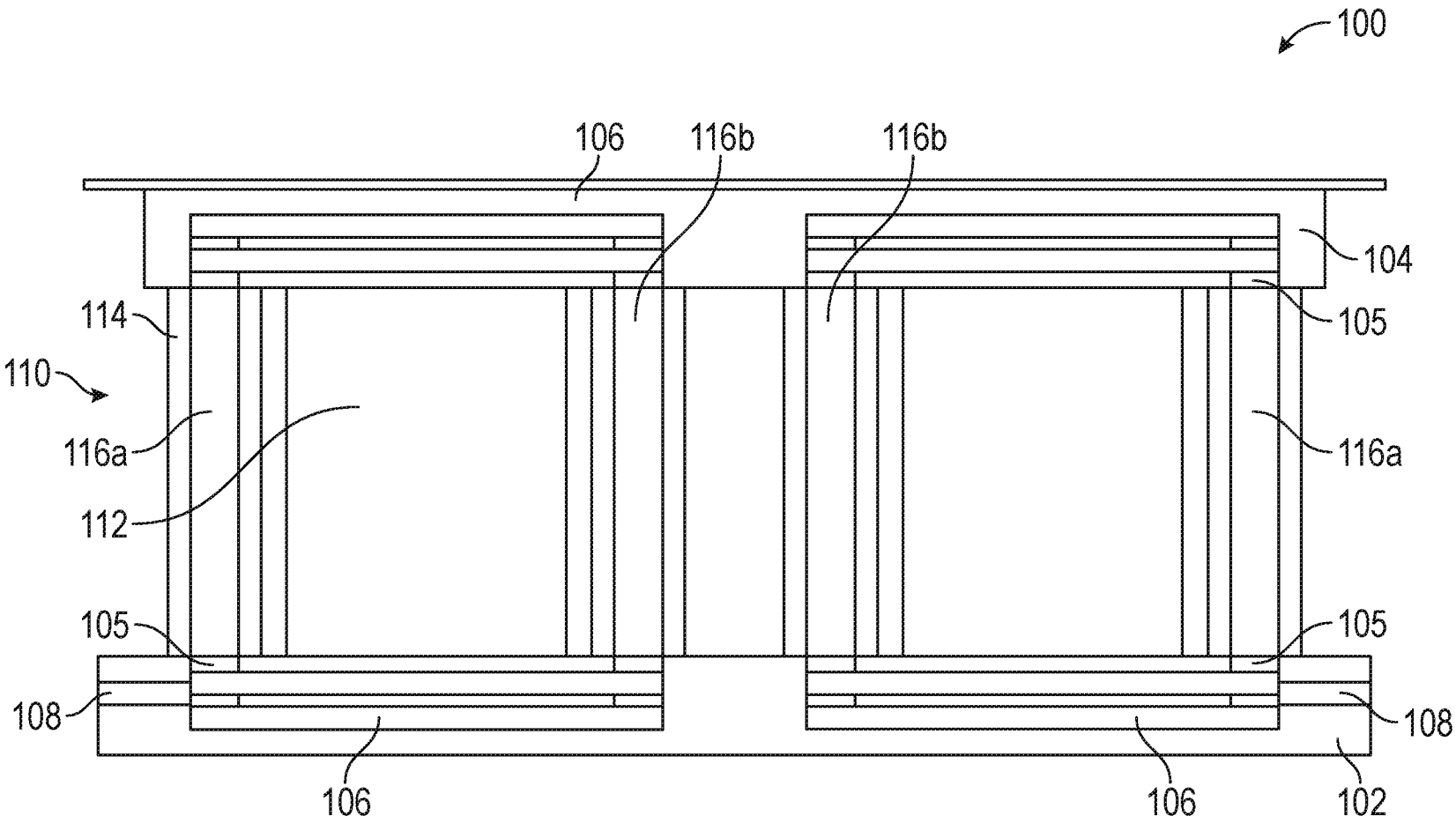
FIG. 1C is a cross sectional view of the electrical device assembly of FIG. 1A.

Referring to the drawings, FIGS. 1A-1C show an electrical device assembly 100. In the illustrated embodiment, the electrical device assembly 100 includes a lower printed wiring board 102, an upper printed wiring board 104, and a connector assembly 110. In the illustrated embodiment, the electrical device assembly 100 can be configured to operate as an inductor, transformer, etc. In the illustrated embodiment, the electrical device assembly 100 is shown as an inductor to filter input and output signals. Advantageously, the use of the connector assembly 110 allows for electrical connections needed for operation to be simplified.

In the illustrated embodiment, the electrical device assembly 100 allows for electrical connections to be formed in a desired arrangement. In the illustrated embodiment, the electrical device assembly 100 includes insulation barriers 114, an outer flexible connector 116*a*, a device core 112, and an inner flexible connector 116*b*. In the illustrated embodiment, the electrical device assembly 100 can be any suitable shape, including, but not limited to toroid shaped, etc.

In the illustrated embodiment, the outer flexible connector 116*a* and the inner flexible connector 116*b* are spaced apart with a device core 112 disposed therebetween. In the illustrated embodiment, the device core 112 is a solid core formed from any suitable material, including, but not limited to ferromagnetic materials. In certain embodiments, the device core 112 is an air core. Further, in the illustrated embodiment, insulation barriers 114 can be disposed around the outer flexible connector 116*a* and the inner flexible connector 116*b* to prevent unintended electrical connections within the electrical device assembly 100 and provide structural support.

Figure 4:
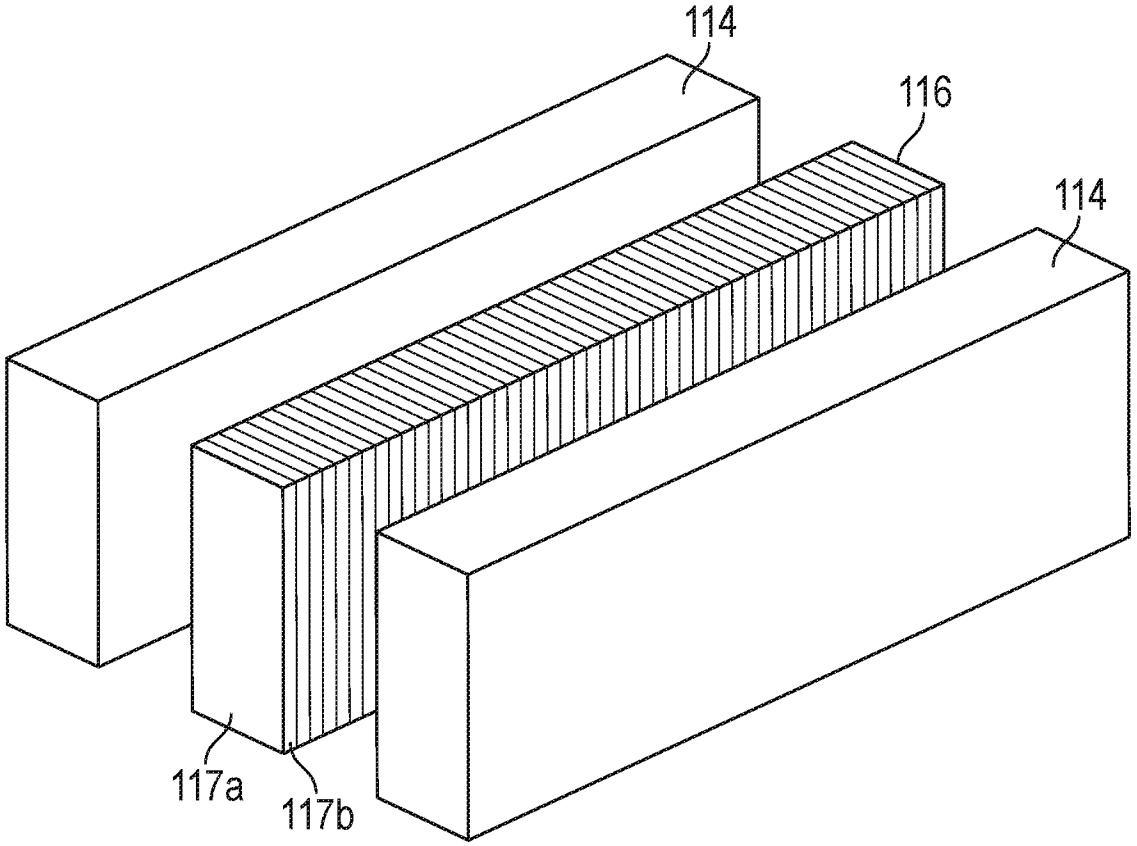
FIG. 4 is an isometric view of a flexible connector for use with the electrical device assembly of FIG. 1A.

In the illustrated embodiment, electricity can flow within the flexible connectors 116*a*, 116*b* in a desired path to allow for a desired function, such as an inductor, transformer, etc. Referring to FIG. 4, each of the flexible connectors, generally referred to as flexible connector 116, includes alternating flexible conductors 117*a* and flexible insulators 117*b*. Advantageously, the flexible connector 116 provides a unitary body containing a plurality of flexible conductors 117*a*, allowing for conductive paths to be selectively created as desired quickly and inexpensively. Further, by utilizing flexible conductors 117*a* and flexible insulators 117*b*, the flexible connector 116 can withstand vibrations.

Referring back to FIGS. 1A-1C, the electrical device assembly 100 is disposed between the lower printed wiring board 102 and the upper wiring board 104. In the illustrated embodiment, the printed wiring boards 102,104 support and facilitate electrical connections through the electrical device assembly 100 to allow functionality as an inductor, transformer, etc.

Figure 2:
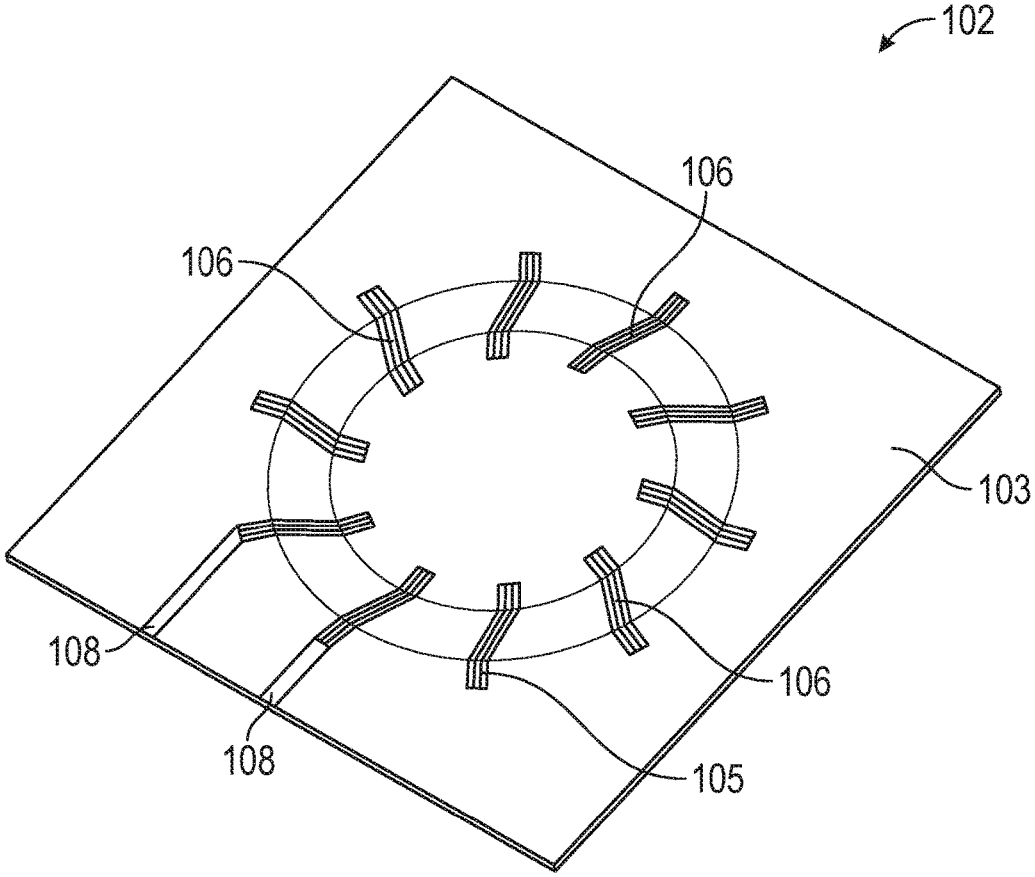
FIG. 2 is an isometric view of a lower printed wiring board for use with the electrical device assembly of FIG. 1A.
Figure 3:
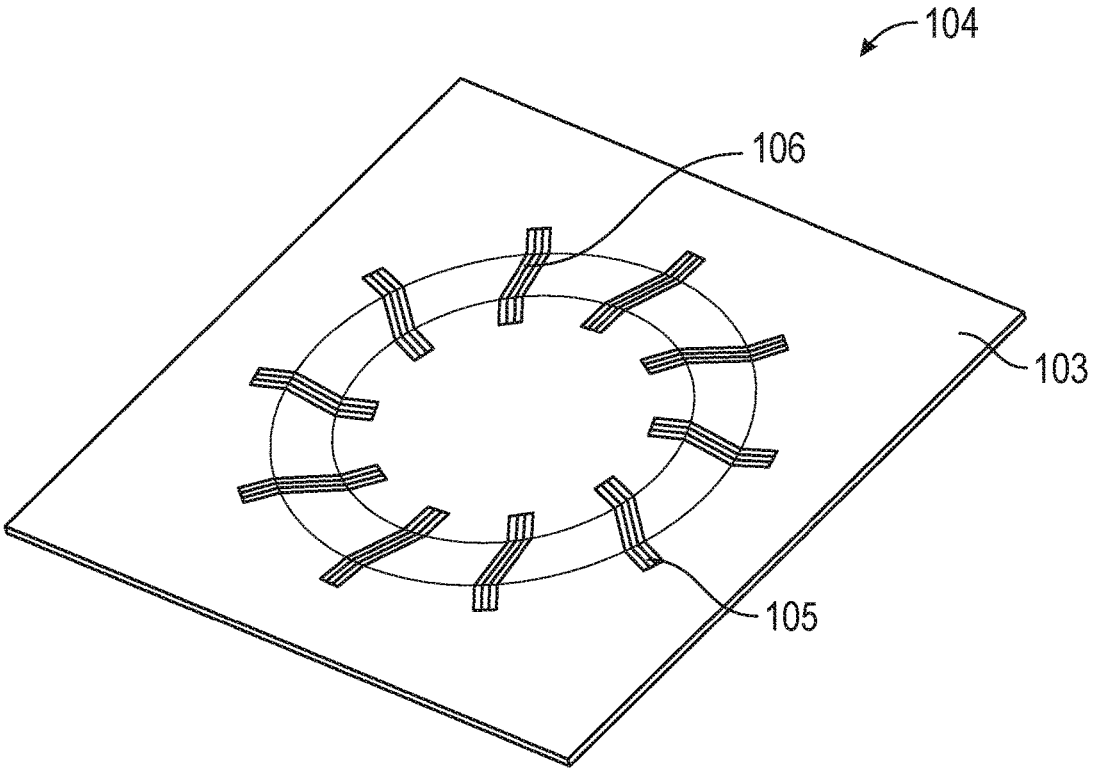
FIG. 3 is an isometric view of an upper printed wiring board for use with the electrical device assembly of FIG. 1A.

Referring to FIGS. 1A-2, the lower printed wiring board 102 is shown. In the illustrated embodiment, the lower printed wiring board 102 includes contact pads 105, interconnects 106, and input/output traces 108. In the illustrated embodiment, the lower printed wiring board 102 is formed from any suitable printed wiring board material 103, including, but not limited to copper sheets laminated onto a non-conductive substrate.

In the illustrated embodiment, conductive interconnects 106 can be formed within the lower printed wiring board 102. The conductive interconnects 106 can be copper conductive pathways. In the illustrated embodiment, the interconnects 106 are embedded within the lower printed wiring board 102 and are otherwise insulated. In the illustrated embodiment, ends of the interconnect 106 include contact pads 105 that are formed on the surface of the lower printed wiring board 102. In the illustrated embodiment, the interconnect 106 allows electrical contact between one contact pad 105 and the opposite contact pad 105 on the opposite end of the interconnect 106. In the illustrated embodiment, the contact pads 105 and the interconnects 106 allow for electrical contact between conductors of the outer flexible connector 116*a* and the inner flexible connector 116*b*.

In the illustrated embodiment, the contact pads 105 are aligned with the conductors within the flexible connectors 116*a*, 116*b* to allow electrical contact between the conductors within the outer flexible connector 116*a* and the inner flexible connector 116*b*.

In the illustrated embodiment, input/output traces 108 can provide electricity into and out of the electrical device assembly 100. In the illustrated embodiment, the input/output traces 108 are electrically connected to select interconnects 106 to allow for electricity to flow through a desired path through the connector assembly 110.

Referring to FIGS. 1A-C and FIG. 3, the upper printed wiring board 104 is shown. In the illustrated embodiment, the upper printed wiring board 104 includes contact pads 105 and interconnects 106. In the illustrated embodiment, the upper printed wiring board 104 is formed from any suitable printed wiring board material 103, including, but not limited to copper sheets laminated onto a non-conductive substrate.

In the illustrated embodiment, conductive interconnects 106 can be formed within the upper printed wiring board 104. The conductive interconnects 106 can be copper conductive pathways. In the illustrated embodiment, the interconnects 106 are embedded within the upper printed wiring board 104 and are otherwise insulated. In the illustrated embodiment, ends of the interconnect 106 include contact pads 105 that are formed on the surface of the upper printed wiring board 104. In the illustrated embodiment, the contact pads 105 allow electrical contact between one contact pad 105 and the opposite contact pad 105 on the opposite end of the interconnect 106. In the illustrated embodiment, the contact pads 105 and the interconnects 106 allow for electrical contact between conductors within the outer flexible connector 116*a* and the inner flexible connector 116*b*.

In the illustrated embodiment, the contact pads 105 are aligned with the conductors within the flexible connectors 116*a*, 116*b* to allow electrical contact between the conductors within the outer flexible connector 116*a* and the inner flexible connector 116*b*.

Referring to FIG. 1C, in the illustrated embodiment, the lower printed wiring board 102 and the upper printed wiring board 104 facilitate desired electrical connections through the flexible connectors 116*a*,116*b* to allow the electrical device assembly 100 to function as desired. In the illustrated embodiment, the configuration of the lower printed wiring board 102, the upper printed wiring board 104, and the flexible connectors 116*a*, 116*b* allows for a coiled electrical path to allow for functionality as an inductor.

For example, in the illustrated embodiment, electrical current can flow into the electrical device assembly 100 via the input/output trace 108, wherein the input/output trace 108 is connected to an interconnect 106 ($I_{Lower}$) disposed within the lower printed wiring board 102. In the illustrated embodiment, the contact pad 105 and the interconnect 106 ($I_{Lower}$) are aligned within the lower printed wiring board 102 with the outer flexible connector 116*a* to allow a flexible conductor 117*a* (FIG. 4) ($C_{Outer1}$) of the outer flexible conductor 116*a* to be electrically connected to the interconnect 106 ($I_{Lower}$) within the lower printed wiring board 102. In the illustrated embodiment, the interconnect 106 ($I_{Lower}$) is further electrically connected to the opposite contact pad 105, wherein the opposite contact pad 105 is aligned with a flexible conductor 117*a* ($C_{Inner1}$) of the inner flexible connector 116*b*.

Similarly, in the illustrated embodiment, the contact pad 105 and the interconnect 106 ($I_{Upper}$) within the upper printed wiring board 104 are aligned with the inner flexible connector 116*b* to allow the flexible conductor 117*a* (FIG. 4) ($C_{Inner1}$) to be electrically connected to the interconnect 106 ($T_{Upper}$) within the upper printed wiring board 104. In the illustrated embodiment, the interconnect 106 ($T_{Upper}$) is electrically connected with the opposite contact pad 105, wherein the opposite contact pad 105 is aligned with the next or adjacent flexible conductor 117*a* ($C_{Outer2}$) of the outer flexible connector 116*a*. Advantageously, this allows for a coil type power flow path without expensive and complex wiring configurations. In other embodiments, any suitable power flow path configuration can be utilized.

Figure 5:
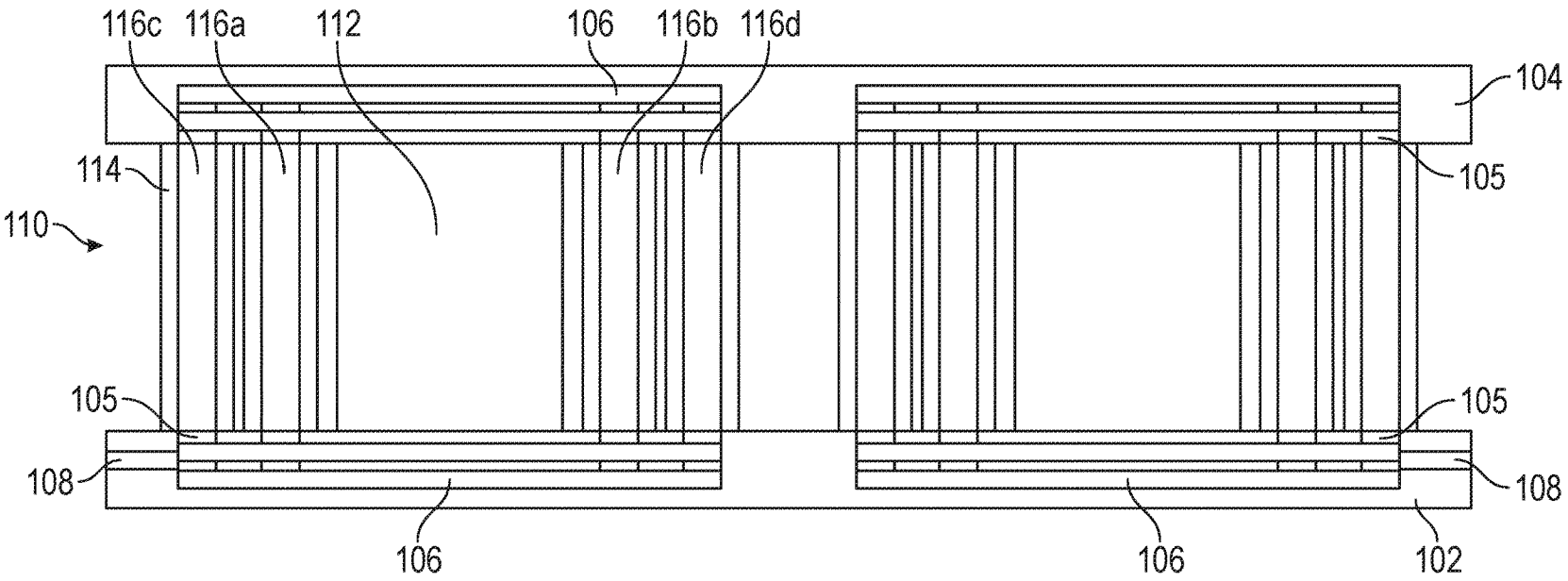
FIG. 5 is a cross sectional view of an embodiment of an electrical device assembly.

Referring to FIG. 5, in the illustrated embodiment, an electrical device assembly 200 is shown. In the illustrated embodiment, the electrical device assembly 200 is similar to the electrical device assembly 100 described herein, but further includes additional flexible connectors 116*c*, 116*d*. In the illustrated embodiment, the additional flexible connectors 116*c*, 116*d* can be utilized to provide additional current flow paths or to provide additional current capability. In certain embodiments, the flexible connector 116*c* can be wired in parallel with the outer flexible connector 116*a* to provide additional current capability. Similarly, the flexible connector 116*d* can be wired in parallel with the inner flexible connector 116*b*. In certain embodiments, the flexible connector 116*c* can be wired in series with the outer flexible connector 116*a* to provide additional looping current paths. Similarly, the flexible connector 116*d* can be wired in series with the inner flexible connector 116*b*. In other embodiments, the flexible connectors 116*c*, 116*d* can be wired in any suitable configuration.

The terminology used herein is for the purpose of describing particular embodiments only and is not intended to be limiting of the embodiments. While the description of the present embodiments has been presented for purposes of illustration and description, it is not intended to be exhaustive or limited to the embodiments in the form disclosed. Many modifications, variations, alterations, substitutions or equivalent arrangement not hereto described will be apparent to those of ordinary skill in the art without departing from the scope and spirit of the embodiments. Additionally, while various embodiments have been described, it is to be understood that aspects may include only some of the described embodiments. Accordingly, the embodiments are not to be seen as limited by the foregoing description, but are only limited by the scope of the appended claims.

What is claimed is:

1. An electrical device, comprising:

a continuous ring-shaped first flexible connector defining an annular space, the continuous ring-shaped first flexible connector including:

a first flexible conductor and a second flexible conductor; and a flexible insulator disposed between the first flexible conductor and the second flexible conductor;

a continuous ring-shaped second flexible connector disposed within the annular space and spaced apart from the continuous ring-shaped first flexible connector to define a ring-shaped annular region between an interior of the continuous ring-shaped first flexible connector and an exterior of the continuous ring-shaped second flexible connector, the continuous ring-shaped second flexible connector including a third flexible conductor;

a first interconnect to electrically connect the first flexible conductor and the third flexible conductor;

a second interconnect to electrically connect the third flexible conductor and the second flexible conductor, wherein the second interconnect is disposed opposite the first interconnect; and a ring-shaped core disposed in the ring-shaped annular region defined between the interior of the continuous ring-shaped first flexible connector and the exterior of the continuous ring-shaped second flexible connector, wherein respective upper and lower ends of each of the continuous ring-shaped first flexible connector, the continuous ring-shaped second flexible connector and the ring-shaped core are coplanar.

2. The electrical device of claim 1, wherein the first interconnect includes a contact pad.

3. The electrical device of claim 2, wherein the contact pad is aligned with the first flexible conductor to electrically connect the first flexible conductor with the first interconnect.

4. The electrical device of claim 1, wherein the first interconnect is electrically connected to an input/output trace.

5. The electrical device of claim 1, wherein the first interconnect is disposed within a first printed wiring board.

6. The electrical device of claim 1, wherein the second interconnect is disposed within a second printed wiring board.

7. The electrical device of claim 1, wherein the first flexible connector is a unitary connector.

8. The electrical device of claim 1, wherein the first flexible connector and the second flexible connector form a toroid.

9. The electrical device of claim 1, further comprising an insulation barrier disposed adjacent to the first flexible connector.

10. The electrical device of claim 1, wherein the electrical device is an inductor.

11. The electrical device of claim 1, wherein the electrical device is a transformer.

12. An electrical device, comprising:

a first printed wiring board including a first interconnect;

a second printed wiring board including a second interconnect;

a continuous ring-shaped first flexible connector disposed between the first printed wiring board and the second printed wiring board, the continuous ring-shaped first flexible connector defining an annular space and including:

a first flexible conductor and a second flexible conductor;

a flexible insulator disposed between the first flexible conductor and the second flexible conductor;

a continuous ring-shaped second flexible connector disposed within the annular space and spaced apart from the continuous ring-shaped first flexible connector to define a continuous ring-shaped annular region between an interior of the continuous ring-shaped first flexible connector and an exterior of the continuous ring-shaped second flexible connector, the continuous ring-shaped second flexible connector being disposed between the first printed wiring board and the second printed wiring board and including a third flexible conductor;

wherein the first interconnect electrically connects the first flexible conductor and the third flexible conductor, and the second interconnect electrically connects the third flexible conductor and the second flexible conductor, wherein the second interconnect is disposed opposite the first interconnect; and a ring-shaped core disposed in the ring-shaped annular region defined between the interior of the continuous ring-shaped first flexible connector and the exterior of the continuous ring-shaped second flexible connector, wherein respective upper and lower ends of each of the continuous ring-shaped first flexible connector, the continuous ring-shaped second flexible connector and the ring-shaped core are coplanar at the respective innermost surfaces of the first and second printed wiring boards, respectively.

13. The electrical device of claim 12, wherein the first interconnect includes a contact pad disposed on the first printed wiring board.

14. The electrical device of claim 13, wherein the contact pad is aligned with the first flexible conductor to electrically connect the first flexible conductor with the first interconnect.

15. The electrical device of claim 12, wherein the first interconnect is electrically connected to an input/output trace disposed on the first printed wiring board.

* * * * *